US008051518B2

(12) United States Patent
Massaro

(10) Patent No.: US 8,051,518 B2
(45) Date of Patent: Nov. 8, 2011

(54) COMBINATION TOOL

(76) Inventor: Daniel J. Massaro, Bohemia, NY (US)

( * ) Notice: Subject to any disclaimer, the term of this patent is extended or adjusted under 35 U.S.C. 154(b) by 324 days.

(21) Appl. No.: 12/344,412

(22) Filed: Dec. 26, 2008

(65) Prior Publication Data

US 2010/0162570 A1 Jul. 1, 2010

(51) Int. Cl.
*B26B 11/00* (2006.01)

(52) U.S. Cl. ..... 7/161; 7/120; 407/29.15; 30/138

(58) Field of Classification Search ..... 7/158, 161, 7/166, 162, 118, 120; 30/123, 138, 162; 407/29.11, 29.15; 254/21, 25
See application file for complete search history.

(56) References Cited

U.S. PATENT DOCUMENTS

| | | | | | |
|---|---|---|---|---|---|
| 681,176 | A | * | 8/1901 | Albach | 30/123.5 |
| 2,980,996 | A | | 4/1961 | Beran | |
| 4,890,387 | A | | 1/1990 | Canino | |
| 5,001,796 | A | | 3/1991 | Desjardins | |
| D360,817 | S | | 8/1995 | Moyer, Jr. | |
| D361,253 | S | * | 8/1995 | McCoy | D8/98 |
| 5,519,908 | A | * | 5/1996 | Steinman et al. | 7/158 |
| 5,623,737 | A | * | 4/1997 | Moyer et al. | 7/158 |
| D386,381 | S | | 11/1997 | Black | |
| D389,014 | S | | 1/1998 | Hasegawa | |
| 5,823,719 | A | * | 10/1998 | Tyler | 407/29.1 |
| 5,997,221 | A | | 12/1999 | Sadler | |
| D453,896 | S | | 2/2002 | Hirai | |
| D478,493 | S | | 8/2003 | Martone | |
| 7,003,833 | B2 | | 2/2006 | Feliciano | |
| 7,340,836 | B2 | | 3/2008 | Whitemiller | |

* cited by examiner

*Primary Examiner* — Debra S Meislin
(74) *Attorney, Agent, or Firm* — Harold G. Furlow, Esq

(57) ABSTRACT

A combination tool is described that has a housing that includes a first side and an opposed second side, a third side and an opposed fourth side. The sides connect together to define the housing. The housing includes a first end portion and an opposed second end portion that define a longitudinal axis. The combination tool includes a razor mechanism that is connected to the housing. The razor mechanism receives and moves a cutting blade between a first position in the cavity and a second position wherein the cutting blade extends through the housing. The housing defines a channel that includes a floor, a first sidewall and a second sidewall. The first sidewall and the second sidewall have first edges that are connected to the floor and second edges that connect to the first side of the housing. The first sidewall includes a first slot and the second sidewall includes an opposed second slot. The first slot and second slot are positioned in fixed spaced relation from the floor and the second edge. The slots are configured to receive a rasp. The slots are positioned to recess a cutting surface of the rasp in the channel such that at least a portion of the sidewalls extend between the cutting surface and the second edges. A claw is defined in the housing that includes a first tong and a second tong. The claw extracts fasteners from soft materials.

15 Claims, 4 Drawing Sheets

COMBINATION TOOL

BACKGROUND OF THE INVENTION

1. Field of the Invention

The present disclosure relates to combination tools used in construction and in particular, to a combination tool that aids in the installation of panels.

2. Description of the Related Art

Combination tools are multi-purpose devices that can be specialized or encompass a broad range of applications. Construction and remodeling often requires the installation of panels or sheeting such as wallboard, cellulose based sheeting, polymers and insulation panels. The installation of paneling requires repetitive tasks such cutting the panel such as a piece of wallboard to the desired dimensions, resurfacing the cut edges for a smooth tight fitting joint, installing and joining the pieces of wallboard together. The resurfacing of the cut edge of the piece of wallboard is required because of the rough surface of the edges after a piece of wallboard is cut and the need for a precision uniform mating surface for any edge in a joint with another piece of wallboard. The skilled tasks of cutting to size and then the resurfacing of the edges remain awkward because of the need to handle multiple tools to perform this task.

Retractable cutting knifes or utility knifes are routinely used to cut or scar the surface of materials such as wallboard for separation into pieces. Utility knifes typically have handles that have an overall ergonomic shape for gripping that includes an approximately rectangular cross-section similar to the handle of a large knife. The elongate length of the handle is aligned with the retractable cutting blade and the relatively narrow width of the housing aids in the handling and alignment of the cutting process.

In contrast, rasps configured for cutting the edges of panels are bulky in that they are separate tools with a flat cutting surfaces that includes an extended handle or are U-shaped with a channel that has a width suitable for the positioning of the edge of the panel. Rasps that have the U-shaped channel configuration for the resurfacing of the edge of a piece of paneling do not require a separate alignment of the rasp with the edge for a precision cut because the channel sides guide the cutting of the rasp. Rasps are also limited in that they typically only cut in a single longitudinal direction. A multi-functional tool is needed that has a housing that is a handle that readily fits into a user's hand for accurate cutting with a retractable blade that can also be rotated to use a rasp positioned in a channel in the housing to resurface the edge of a piece of paneling.

Paneling is routinely fastened onto the structure of a building using threaded fasteners that can be rapidly drilled through the panel and into the supporting structure. It is not uncommon, however, that the fastener is accidentally imbedded into the panel without being connected to a stud or the threads of the fastener no longer engage the panel. The use of a large flat bladed claw hammer commonly found in construction operations to extract the fastener under these circumstances causes excessive damage to the panel. A specialized claw is needed for panels and similar soft material applications that can remove a fastener with a minimal amount of damage to the panel.

A combination tool is needed that is contained in a housing that can be readily manipulated to switch between cutting as a utility knife and resurfacing a rough edge with a rasp positioned in a channel. A further need is for the combination tool to include a claw that can extract a fastener from softer materials.

SUMMARY OF THE INVENTION

A combination tool is described that comprises a housing that has a first side that is opposed by a second side and a third side that is opposed by a fourth side. The housing includes a first end portion and an opposed second end portion. The first side, second side, third side and fourth side are connected to define the housing. The first end portion and second end portion define a longitudinal axis. The housing defines an interior cavity and an aperture that are in fluid communication.

A razor mechanism is connected to the housing that is adapted to receive a cutting blade. The razor mechanism moves the cutting blade between a first position in the cavity and a second position extending through the aperture of the housing.

A channel is defined in the first side of the housing that includes a floor, a first sidewall and a second sidewall. The first sidewall and the second sidewall have a first edge that is connected to the floor and an opposed second edge that is connected to the first side of the housing. The first sidewall and the second sidewall are aligned. The first sidewall includes a first slot and the second sidewall includes an opposed second slot. The first slot and second slot are positioned in fixed spaced relation from the floor and the second edge. The slots are adapted to receive the rasp. The slots are adapted to recess a cutting surface of the rasp in the channel such that at least a portion of the sidewalls extend between the cutting surface and the second edges.

The combination tool includes a claw that has first tong and a second tong. One of the end portions of the combination tool includes the claw. The claw defines a first notch that is adapted to receive the head of a fastener. The first tong and the second tong have terminal ends that taper to define a point. The claw is adapted for the extraction of fasteners from soft materials. The claw includes a selectively removable and replaceable plug.

The housing can include an attachment mechanism that secures the rasp in the slots in the sidewalls. The combination tool can further include a set of removable and replaceable cutting surfaces. The slots in the sidewalls can include branches adapted to vary the alignment of at least a portion of the rasp relative to the floor. The first side and the second side have a first width, the third side and fourth side have a second width that is less than the first width. The channel is defined in at least one of the sides with the first width.

A hand held combination tool is described that comprises a housing that includes a first side, a second side opposed to the first side, a third side and a fourth side opposed to the third side. The housing is elongate and includes a first end portion and an opposed second end portion. The first end portion and second end portion define a longitudinal axis. The first side, second side, third side and fourth side are connected together to define the housing. The housing defines a cavity and an aperture that are in fluid communication.

A razor mechanism is connected to the housing. The housing defines an interior cavity that is in fluid communication with an aperture in the first end portion. The razor mechanism moves the cutting blade between a first position in the cavity and a second position extending through the aperture of the housing.

A channel is defined in the housing that includes a floor, a first sidewall and a second sidewall. The first sidewall and second sidewall have a first edge that is connected to the floor and a second edge that is connected to the first side of the housing. The first sidewall and the second sidewall are opposed walls. The floor of the channel defines a cutting surface.

A claw is connected to the second end portion. The claw includes at least two tongs separated by a notch. The claw is adapted to extract fasteners from soft materials. The housing can include a removable and replaceable plug for the claw.

The sidewalls of the channel can optionally define opposed slots that are adapted to position a rasp in fixed spaced relation to the floor and the second edge. The slots in the sidewalls can include branches that vary at least a portion of the position of the rasp relative to the floor. The slots can include a plurality of slots that are adapted to position a cutting surface of the rasp in proximity to the second edge.

A method for using a hand held combination tool to cut a panel constructed of materials suitable for the application of a rasp of the hand held combination tool. The method for using the combination tool comprising the steps of providing a combination tool that includes a cutting blade and a rasp positioned in a channel. The channel includes sidewalls and a floor. The rasp is removably positionable in the channel.

A step of cutting a panel using the combination tool includes cutting the panel using the blade and separating the panel into pieces. Each piece defines edges from the separating of the panel into pieces. A step of cutting the surface of the edge using the rasp includes rotating the combination tool about the longitudinal axis, aligning the channel to one of the edges, positioning the edge in the channel, using the sidewall to guide the rasp along the edge, and cutting the surface of the edge of the panel using the rasp.

The step of cutting can further include using a razor mechanism to move the cutting blade between a first position in the combination tool and a second position extending from the combination tool. The step of providing can also include positioning a rasp in the slots in the channel and the interface between the slots and the rasp retaining the rasp in position during normal use. The step of providing can further include the floor of the channel defining a cutting surface. The step of providing can also encompass the combination tool including a claw for extracting fasteners from soft materials and further including a step of using the claw to extract a fastener from a soft material.

BRIEF DESCRIPTION OF THE DRAWINGS

Preferred embodiments of the disclosure are described below with reference to the drawings, wherein like numerals are used to refer to the same or similar elements.

DETAILED DESCRIPTION OF THE INVENTION

Figure 1:
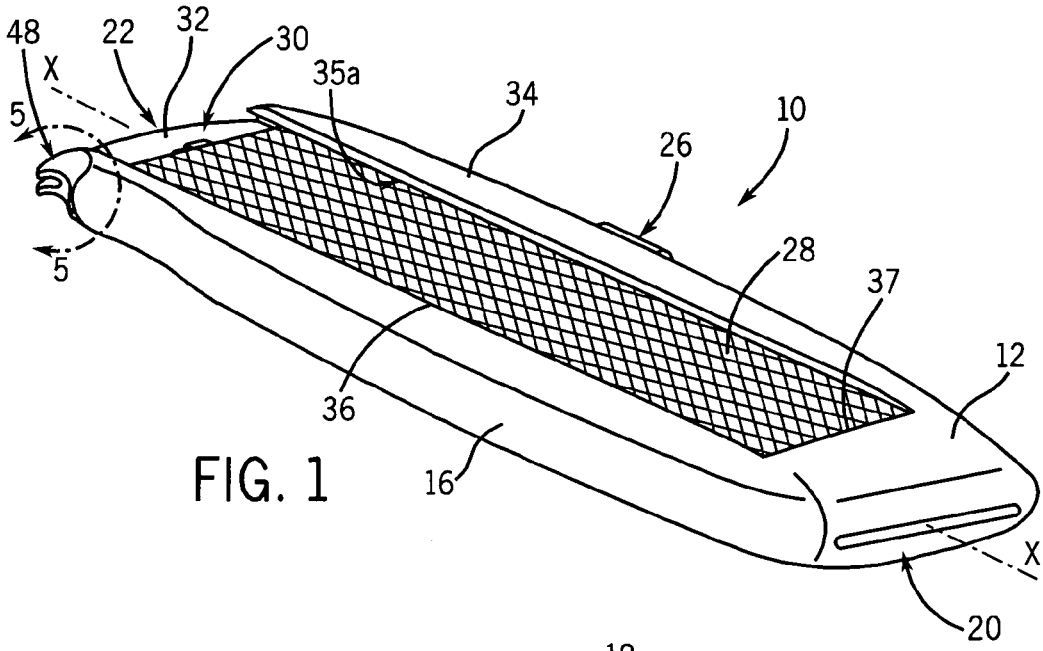
FIG. 1 is a perspective view of a first end portion and a first side of a combination tool constructed in accordance with the present disclosure.
Figure 2:
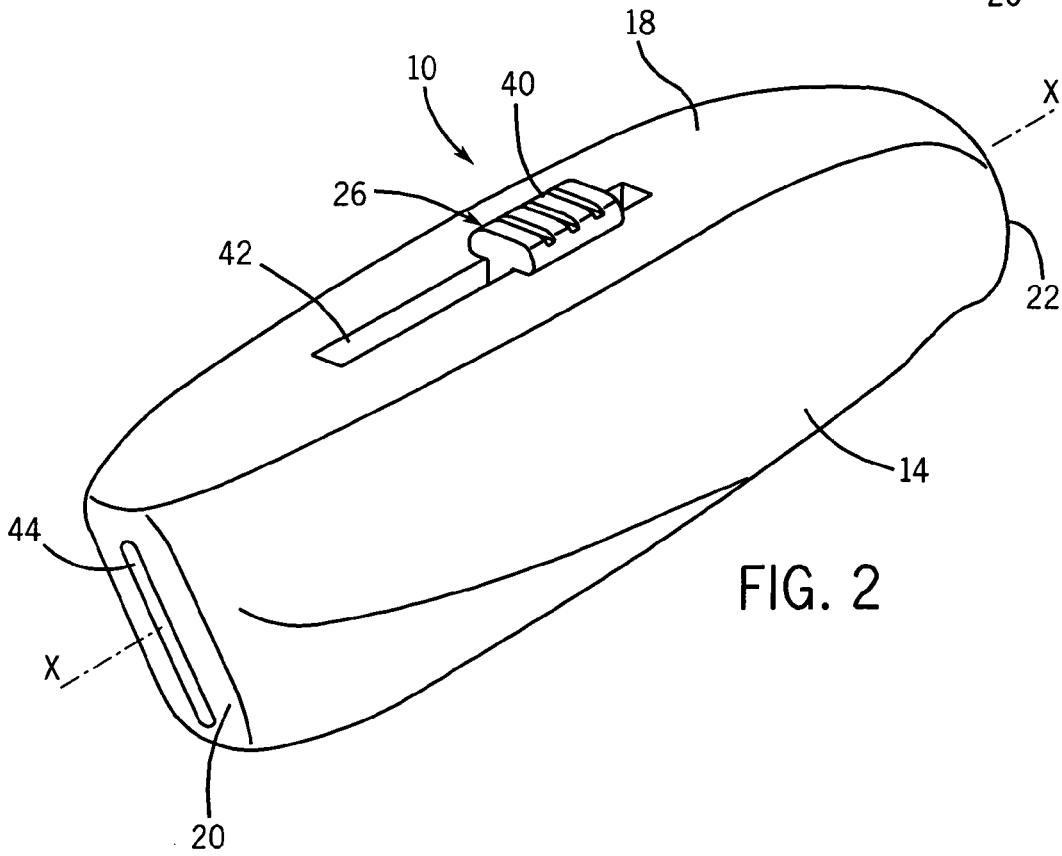
FIG. 2 is a perspective view of the first end portion and a second side of the combination tool of FIG. 1.

Referring initially to FIGS. 1 and 2, combination tool 10 includes an elongate housing that is a handle for a plurality of tools. The housing includes a first side 12, a second side 14, a third side 16 and a fourth side 18. First side 12 and second side 14 are opposed and have a first width. Third side 16 and fourth side 18 are opposed and have a second width that is preferably less than the first width. The housing also includes a first end portion 20 that is opposed to a second end portion 22. A central longitudinal axis-X extends along the elongate centerline of the housing through first end portion 20 and second end portion 22.

The housing preferably has an approximately rectangular cross-section that is ergonomically shaped for gripping with a single hand. Sides 12 and 14 are connected together on their longitudinally aligned sides by sides 16 and 18 to define the four elongate corners of the housing. First end portion 20 and second end portion 22 are tapered. Combination tool 10 includes a razor mechanism 26.

Combination tool 10 includes one or more files or rasps 28 for filing or cutting materials such as wallboard, cellulose products, polymers, composites and metals. In this one preferred embodiment, rasp 28 is an elongate thin piece of sheet metal that approximates a planar shaped bar with an outwardly directed first side or face that is a cutting surface and an opposed second side that is inwardly directed. Rasp 28 can have any shape such as a "half round" or flat, for example. Similarly, rasp 28 can have any level of coarseness or have cutting edges in one or both longitudinal directions. In this preferred embodiment, rasp 28 includes a plurality of three-dimensional folds on the surface of the blade that define a plurality of apertures with extended pointed projections configured for cutting in a single direction.

Figure 3:
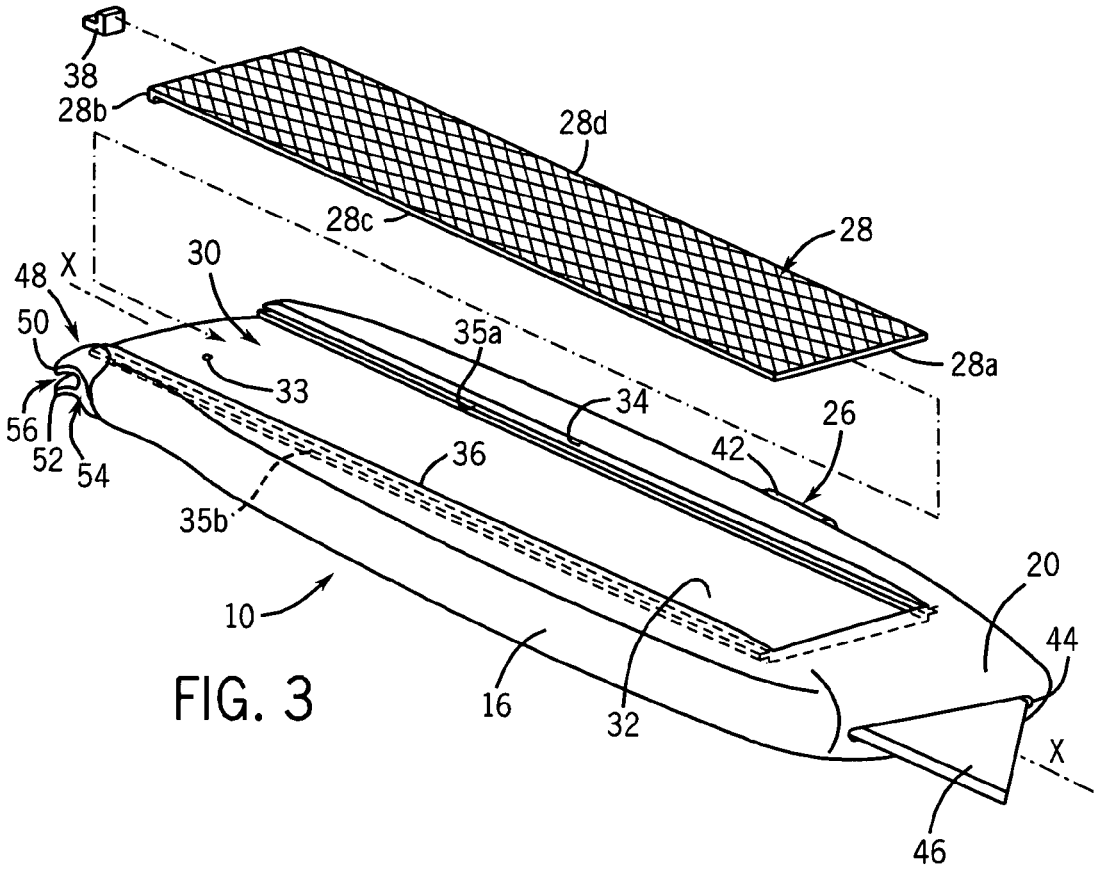
FIG. 3 is an exploded perspective view of the first end portion and the first side that shows a rasp separated from the channel of the combination tool and a cutting blade of the combination tool of FIG. 1.

As shown in FIGS. 1-3, a channel 30 is defined in first side 12 that includes a floor 32, a first sidewall 34 and an opposed second sidewall 36 that are aligned with the longitudinal axis. Sidewalls 34 and 36 extend between floor 32 and first side 12 and are parallel planar smooth surfaced walls without a cutting surface. Channel 30 preferably includes an end wall 37 that is connected to sidewalls 34 and 36 and floor 32 to terminate channel 30 in proximity to first end portion 20. End wall 37 is approximately perpendicular to the longitudinal axis, floor 32 and sidewalls 34 and 36. The opposed longitudinal end of channel 30 is an open end in proximity to second end portion 22. A slot 35*a* is defined in sidewall 34 that is opposed to a slot 35*b* defined in sidewall 36 (see FIG. 4). Slots 35*a* and 35*b* are positioned in fixed spaced relation to floor 32 and first side 12.

Combination tool 10 defines a second channel when rasp 28 is positioned in slots 35*a* and 35*b*. The second channel includes the face or cutting surface of rasp 28, the extension of wall 34 and wall 36 above the cutting surface of rasp 28 to first side 12. This preferred embodiment provides an air gap between rasp 28 and floor 32.

Rasp 28 preferably has a width and a thickness approximately perpendicular to each other and the longitudinal axis that is received by slots 35*a* and 35*b* in a tight close fitting relation. Rasp 28 has a length along the longitudinal axis that preferably fits into channel 30. Slots 35*a* and 35*b* have a depth in sidewalls 34 and 36, respectively to provide rasp 28 sufficient structural support be an approximately structurally rigid structure when positioned in channel 30.

End wall 37 and the portion of first side 12 in proximity to first end portion 20 is configured with a height from floor 32 that is less than the height of the outward facing cutting surface of rasp 28. At least one of slots 35*a* and 35*b* include a stop in proximity to wall 37 that limits the travel of rasp 28 in slots 35*a* and 35*b* in the direction from second end portion 22 towards first end portion 20. Rasp 28 can also extend at least partially past wall 37 and over the surface of first side 12 in proximity to first end portion 20. The surface of first side 12 in proximity to wall 37 is also recessed relative to the overall surface of first side 12 such that the height of first side 12 in proximity to sidewalls 34 and 36 extends from floor 32 to a height greater than the cutting surface of rasp 28.

It is understood that while slots 35*a* and 35*b* are described as being straight and at opposed positions on sidewalls 34 and 36 such that rasp 28 defines a plane approximately perpendicular to sidewalls 34 and 36, the relative positions of slots 35*a* and 35*b* can be varied on sidewalls 34 and 36. These variations can include alternative slots 35*a* and 35*b* for the positioning of rasp 28 at different angles in channel 30 relative to the longitudinal axis and/or floor 32. The angular positions of rasp 28 can include, for example, angles such as 30, 45 and 60 degrees relative to the plane defined by sidewalls 34 and 36.

Similarly, rasp 28 can selectively have a controlled degree of flexibility such that the shape of rasp 28 can be varied by the alignment of slots 35*a* and 35*b*. For example, the surface of first side 12 and second side 14 is tapered in proximity to first end portion 20 and slots 35*a* and 35*b* have an at least partially angled and/or arcuate portion such that rasp 28 provides an arcuate and/or angled plane for resurfacing that is approximately aligned with the tapered first end portion 20.

Rasp 28 has a first end portion 28*a*, a second end portion 28*b*, a first side 28*c* and a second side 28d. The first end portion 28*a* defines a first edge and the opposed second end portion 28*b* defines a second edge and/or a flange. Rasp 28 preferably defines a plurality of apertures that include directionally aligned projections for cutting or resurfacing as rasp 28 is moved across a surface from the second end portion 28*b* to first end portion 28*a*.

In an alternative embodiment of channel 30, end wall 37 is omitted and floor 32 includes a cutting surface that can be a file or a rasp, for example. Thus, in this embodiment channel 30 defines an open ended through hole in the housing. Slots 35*a* and 35*b* are optional. When included in this embodiment, slots 35*a* and 35*b* terminate at a predetermined location in proximity to first end portion 20 and second end portion 22. Floor 32 in this embodiment is made of materials suitable for use as in rasp and/or file cutting applications. Floor 32 can include cross-sectional shapes that are perpendicular to the longitudinal axis such as half-round depending upon the intended application. Floor 32 can have the same or a different level of coarseness as rasp 28.

Figure 4:
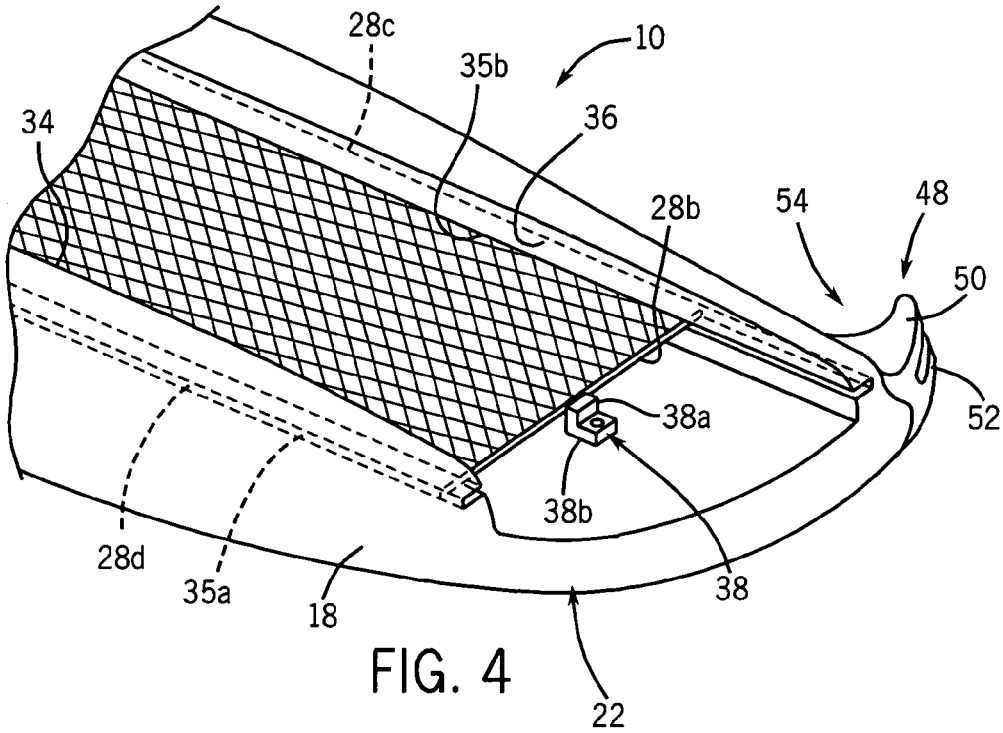
FIG. 4 is a close-up perspective view of a second end portion of the combination tool of FIG. 1 that shows a claw and an exemplary attachment mechanism for the rasp.

Referring now to FIGS. 3 and 4, the housing retains rasp 28 in slots 35*a* and 35*b* of channel 30 during single directional operational use from second end portion 22 to first end portion 20 and the cutting surface of rasp 28 is directed towards second end portion 28*b* and second end portion 22. In this preferred embodiment, the terminal ends of slots 35*a* and 35*b* in proximity to first end portion 20 preclude the movement of rasp 28 in the direction of first end portion 20 during operational use. Rasp 28 is also preferably retained in position in channel by the close fitting relationship between slots 35*a* and 35*b* and rasp 28. The bias inherent in the folds or bends of rasp 28 aids in retaining rasp 28 in slots 35*a* and 35*b*.

In another embodiment of combination tool 10, an attachment mechanism further aids the retention of rasp 28 in position in channel 30. In this embodiment, rasp 28 can cut in either longitudinal direction. In particular, this embodiment preferably accommodates resurfacing in the direction from first end portions 20/28*a* towards second end portions 22/28*b*. The attachment mechanism can include a connector 38 that functions to retain rasp 28 in position in channel 30. Connector 38 can be, for example, a fastener that connects to floor 32 and abuts second end portion 28*b*, a portion of floor 32 that moves and locks against second end portion 28*b* and/or a portion of second end portion 28*b* that engages with channel 30 to fix rasp 28 in position in channel 30.

In this one preferred embodiment of connector 38, channel floor 32 includes an aperture 33 and connector 38 abuts second end portion 28*b* to secure rasp 28 in channel 30. Connector 38 is a right angle piece that has a first side that connects to floor 32 of channel 30 using standard means such as a threaded fastener that extends through an aperture in connector 38 and into aperture 33 in floor 32. A second side of connector 38 extends approximately perpendicular to floor 32 and retains rasp 28 in position in channel 30. Second end portion 28*b*, as required, can include a flange that extends approximately perpendicular to floor 32 and interfaces with the second side of connector 38 to secure rasp 28 in position in channel 30. Alternative connection means can further include a snap or friction fitting between connector 38 and floor 32 or other devices that secure rasp 28 in position in slots 35*a* and 35*b* as described previously.

In this one preferred embodiment, razor mechanism 26 includes a framework (not shown) and an actuator 40 that extends through an aperture 42 in fourth side 18. The housing also defines an aperture 44 in the terminal end of first end portion 20. The framework is connected to the housing, actuator 40 and blade 46. The housing defines an elongate interior cavity that is in fluid communication with apertures 42 and 44 for the selective positioning of razor mechanism 26. Razor mechanism 26 of combination tool 10 is a standard device in which the movement of actuator 40 in aperture 42 moves blade 46.between a first position in the cavity of the housing and a second position extending from the housing. Blade 46 in the second position extends at least partially through slot 44. Razor mechanism 26 can selectively include cutting blade 46.

Combination tool 10 provides for the installation and removal of cutting blades 46. In the preferred embodiment, access to the cavity defined in the housing is provided by standard access means employed by utility knives. These access means can include a housing that is longitudinally separable into two subassemblies and connected by a threaded fastener. Separating the two subassemblies or halves of the housing exposes the interior cavity and razor mechanism 26. Blade 46 can be removed and connected to the framework of razor mechanism 26. Alternative examples of access means to the interior of the housing and razor mechanism 26 include a window in the housing that can be opened and closed as well as razor mechanism 26 extending through aperture 44 sufficiently to provide for the removal and installation of cutting blades 46. Other equivalent access means are known and available for the replacement of cutting blades 46 and are encompassed herein that do not interfere with the additional functions of combination tool 10.

As shown in FIGS. 1 and 4, claw 48 includes a first tong 50 and a second tong 52. Tongs 50 and 52 are elongate tapered extensions that preferably have an arcuate configuration that includes a first surface, a terminal end or tip and a second surface. The first surface is directed outwardly and the second surface of tongs 50 and 52 are directed inwardly towards the housing. The terminal ends of tongs 50 and 52 are preferably aligned approximately perpendicular to the longitudinal axis-X. The terminal ends of tongs 50 and 52 include a dull pointed tip. A notch 54 in third side 16 of the housing is also at least partially defined by the second inwardly directed surfaces of tong 50 and 52. Tong 50 and tong 52 are positioned in fixed spaced relation and separated by a notch 56. Tongs 50 and 52 can be approximately parallel or diverging to define a notch 56 that narrows in the direction of the housing. Tongs 50 and 52 can have any cross-sectional shape to include, for example, circular as well as that of an elongate blade.

Figure 5:
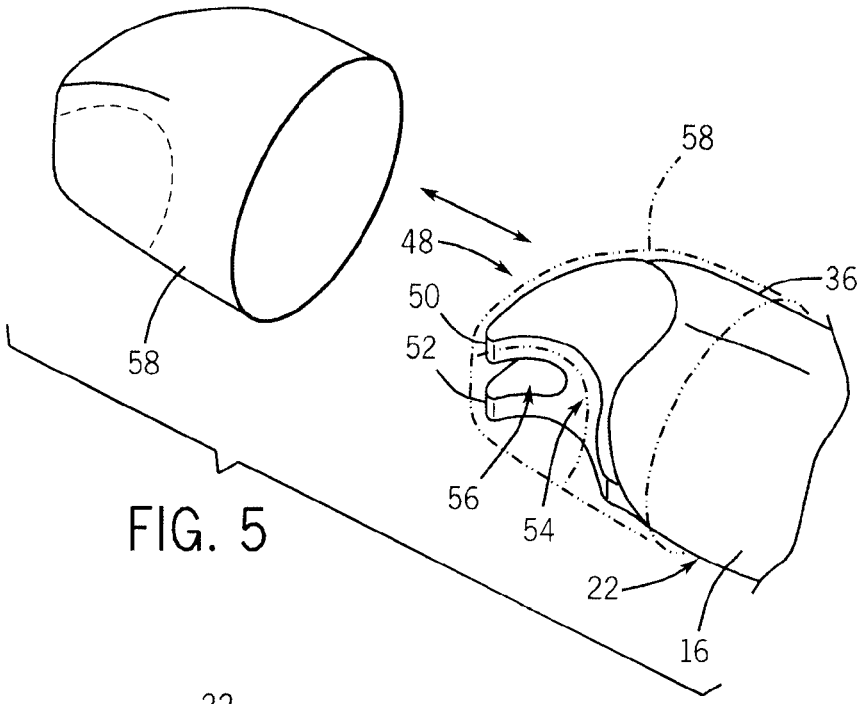
FIG. 5 is a detailed close-up perspective view of the sectional view taken along lines 5-5 of the second end portion of the combination tool FIG. 1 that shows the claw and a plug that is positionable in a notch of the claw.

Referring now to FIGS. 4 and 5, claw 48 is preferably configured such that the terminal ends of tongs 50 and 52 are approximately aligned with the surface of third side 16 of the housing. In this regard, the length and thickness of tongs 50 and 52 is such that claw 48 is structured for the removal of fasteners from relatively soft arid/or thin materials such as wallboard, paneling, insulation board, thin sheets of plywood, select polymers and composites as well as composite board.

In a second embodiment of claw 48, tongs 50 and 52 are approximately aligned with the longitudinal axis-X in a tandem configuration. Tongs 50 and 52 are in fixed spaced relation and notch 54 is defined in the housing between the second surface of tong 50 and the first surface of tong 52. A second notch 56 is defined in the housing at least partially by the second side of tong 52.

Claw 48 can include a plug 58 that is selectively connected to and removable from claw 48. Claw 48 in this preferred embodiment has a first position in which plug 58 reduces the likelihood of the unintentional catching of tongs 50 and 52 when claw 40 is not in active use and a second position in which plug or device 58 is displaced from the first position and claw 48 is positioned for operational use. Plug 58 configurations can include, for example, a resilient approximately cylindrical structure that fits into notch 54, a strip or cap like structure that extends over claw 28 or a strip or a cap like structure that extends between first end portion 20 and second end portion 22 so as to cover claw 48 and rasp 28. Plug 58 is preferably retained in the first position by a bias, snap or friction type fitting. Plug 58 can be attached to the housing by any mariner and can be biased to either the first or the second position.

Referring to FIGS. 1 and 2, in one preferred embodiment, the approximate dimensions of combination tool 10 are as follows: a length along the longitudinal axis of six and a half (6½) inches; a width of one and a half (1½) inches perpendicular to the longitudinal axis along first side 12 and opposed second side 14; and a width of one (1) inch perpendicular to the longitudinal axis along third side 16 and opposed fourth side 18. Channel 30 sidewalls 34 and 36 have a height of five-sixteenth ($5/16^{th}$) of an inch and slots 35*a* and 35*b* for rasp 28 are recessed between one-eighth ($1\frac{1}{8}^{th}$) and five-sixteenth ($5/16^{th}$) of an inch below the surface of first side 12. Rasp 28 has a length along the longitudinal axis of five and one-eighth ($5\frac{1}{8}^{th}$) inches, a width of seven-eighths (⅞) of an inch and a thickness of one-sixteenth ($1/16^{th}$) of an inch. Tongs 50 and 52 have an arcuate length of one-quarter (¼) of an inch. Combination tool 10 is a relatively lightweight tool that can be readily manipulated in a single hand. It is understood that the above dimensions are approximate and can vary further depending upon their intended application of combination tool 10.

Combination tool 10 can be selectively configured for preferential right hand use or left hand use by the alternative positioning of channel 30 and rasp 28 on first side 12 or second side 14. As shown, combination tool 10 favors right-handed use because the palm of the right hand is against first side 12 and channel 30 during the normal operative use of blade 46. In this configuration, the palm of a right-handed user would not normally be in contact with rasp 28 due to its recessed position. A left-handed user, however, with the same grip could be required to position their fingertips on rasp 28. In the alternative configuration of combination tool 10, a left-handed user would position their palm against channel 30 on second side 14 and finger tips on first side 12 during the normal operative use of blade 46. Additional alternatives include reversing the cutting edge of blade 46 to cut in the opposing direction, plug 58 extending over rasp 28 as described previously or other covers or partial covers for channel 30 and/or rasp 28. Similarly, it is understood that while channel 30 can be preferentially positioned on either first side 12 or second side 14, channel 30 and rasp 28 can also be positioned on third side 16 or fourth side 18.

Figure 6:
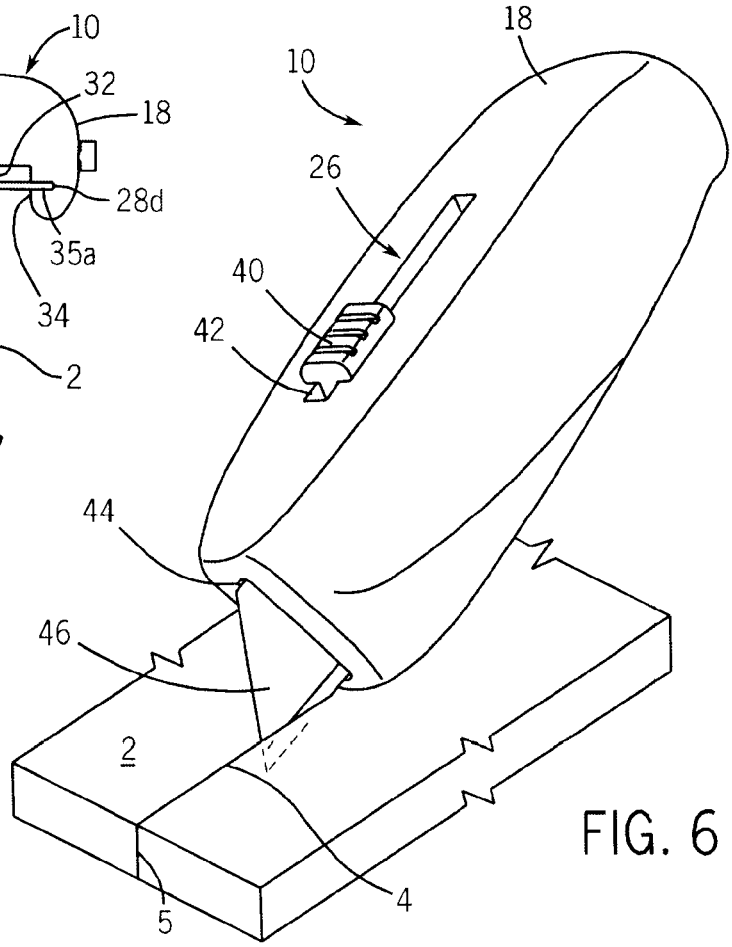
FIG. 6 is a perspective view of the cutting blade of the combination tool of FIG. 1 cutting a piece of wallboard.

In operation, as shown in FIGS. 2 and 6, razor mechanism 26 can be configured with or without blade 46 and/or rasp 28. A blade 46 is installed by accessing razor mechanism 26 using standard means as described previously such as separating the longitudinally divided halves of the housing of combination tool 10 or by other means known to retractable blade or utility knife tools. Blade 46 can have a knife or razor type straight cutting edge or include serrations or cutting teeth for sawing. Blade 46 is secured in the framework of movable razor mechanism 26 and the halves of the housing secured back together. Actuator 40 is then moved in aperture 42 to move blade 46 between the first position in which blade 46 is positioned in the housing of combination tool 10 and the second position in which blade 46 is extending from the housing.

In the second position of razor mechanism 26, blade 46 extends from aperture or slot 44 and actuator 40 is preferably in proximity to first end portion 20. The third relatively narrow side 16 is directed towards panel or wallboard 2 and is aligned with cutting edge of blade 46 and the first side with channel 30 is directed towards the palm of the user. The frame is connected to actuator 40 and retains blade 46 in position during cutting. Blade 46 is shown in the second position making a cut 4 in wallboard 2 that serves as a break line. A rough edge 5 remains from cut 4 on each of the pieces of wallboard, but it is understood that edge 5 can be any edge of panel 2. The approximately rectangular cross-sectional shape and ergonomic attributes of the housing of combination tool 10 functions as a compact narrow handle for the use of blade 46 and a broader handle for the use of rasp 28. When cut 4 is completed, actuator 40 is displaced to return cutting blade 46 to the first position.

Combination tool 10 can be used with floor 32 and/or with a rasp 28 installed in slots 35*a* and 35*b* providing a cutting surface. Rasp 28 is preferably installed by inserting first end portion 28*a* into the open end of slots 35*a* and 35*b* in proximity to second end portion 22. The position of rasp 28 is slots 35*a* and 35*b* of channel 30 leaves an air gap between floor 32 and rasp 28. As required, rasp 28 is guided into the desired branch of slot 35*a* and 35*b* that can define a sloped or arcuate cutting surface as described previously. The cutting surface of rasp 28 is directed outward from the longitudinal axis and preferably oriented such that rasp 28 cuts when moved longitudinally with second end portion 22 leading. With rasp 28 installed to cut in this direction, cutting with rasp 28 drives first end portion 28*a* into the terminal ends of slots 35*a* and 35*b* in proximity to first end portion 20.

When rasp or file 28 is installed for cutting in the opposite longitudinal direction towards first end portion 20 or rasp 28 cuts in both directions the attachment mechanism is required to retain rasp 28 in position in channel 30. First end portion 20 has a slope that is configured to lead into the cutting surface of rasp 28. It is understood that second end portion 22 can include a similar sloped configuration. When channel 30 is configured with opposing walls 37 and leading slopes into rasp 28, apertures are defined in sidewalls 34 and/or 36 that can provide for the release of cuttings from rasp 28.

Figure 7:
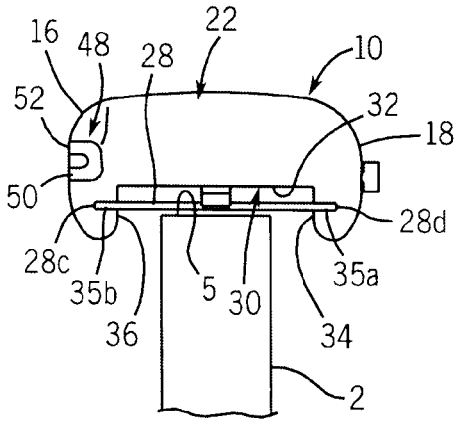
FIG. 7 is an end view of the second end portion of the combination tool of FIG. 1 that shows the blade of the rasp cutting a rough edge of a cut piece of wallboard.

Referring now to FIG. 7, combination tool 10 is rotated approximately ninety degrees about the longitudinal axis from the second position of razor mechanism 26 to align channel 30 on first side 12 with the edge 5 of the wallboard. Tapered first end portion 20 that extends beyond channel 30 can be used to lead edge 5 into channel 30 such that sides 34 and 36 are positioned on opposing sides of edge 5. Sides 34 and 36 guide rasp 28 or floor 32 along edge 5. In this one example, rasp 28 preferably has a directional cutting surface from second edge 28*b* to first edge 28*a* such that second edge 28*b* leads and rasp 28 is drawn longitudinally along edge 5. The application of rasp 28 produces a smooth cut surface suitable for a wallboard joint due to the ability of the user to track along sides 34 and/or 36 of channel 30 to position rasp 28 consistently along edge 5 and thereby rapidly cut a smooth joint surface. When first end portion 28*a* has an arcuate shape as described above, the arcuate portion can be advantageously employed to resurface and shape edge 5 to a concave arcuate shape in wallboard 2. Similarly, as described previously, rasp 28 can be positioned at different angles in channel 30 to create angled mating joints when complex corners are required.

Rasp 28 is positioned to leave an air gap between the second side of rasp 28 and the channel floor 32. The apertures in rasp 28 are voids for passage of cuttings from the operational use of rasp 28 through rasp 28 rather than accumulate on the cutting surface. The cuttings that accumulate on floor 32 can be discarded in the preferred embodiment by positioning first end portion 20 upwards and allowing the cuttings to fall through the open end of channel 30 in proximity to second end portion 22.

Combination tool 10 can include a set of different cutting surfaces that can include one or more rasps 28 that vary in coarseness, flexibility and shape. The initial use of rasp 28 can thus include the selection of one rasp 28 from a plurality of rasp blades. In one preferred alternative embodiment, floor 32 can also be detached and replaced with one or more floors 32 that can vary in coarseness, flexibility and shape. Floor 32 can be employed to produce an alternatively shaped surface than rasp 28, for example. Floor 32 can have a convex half-round shape, for example, that produces a concave channel in edge 5. Floor 32 can also be angled or non-perpendicular relative sides 34 and 36 to produce an angled cut surface for a joint. In one preferred embodiment, combination tool 10 can be applied with a first cutting surface such as a course rasp 28 for a first set of surface cuts and then the cutting surface of floor 32 applied to define a smoother finished surface. The removal and replacement of floor 32 can also provide a window for the removal and replacement of blades 46 from razor mechanism 26.

Figure 8:
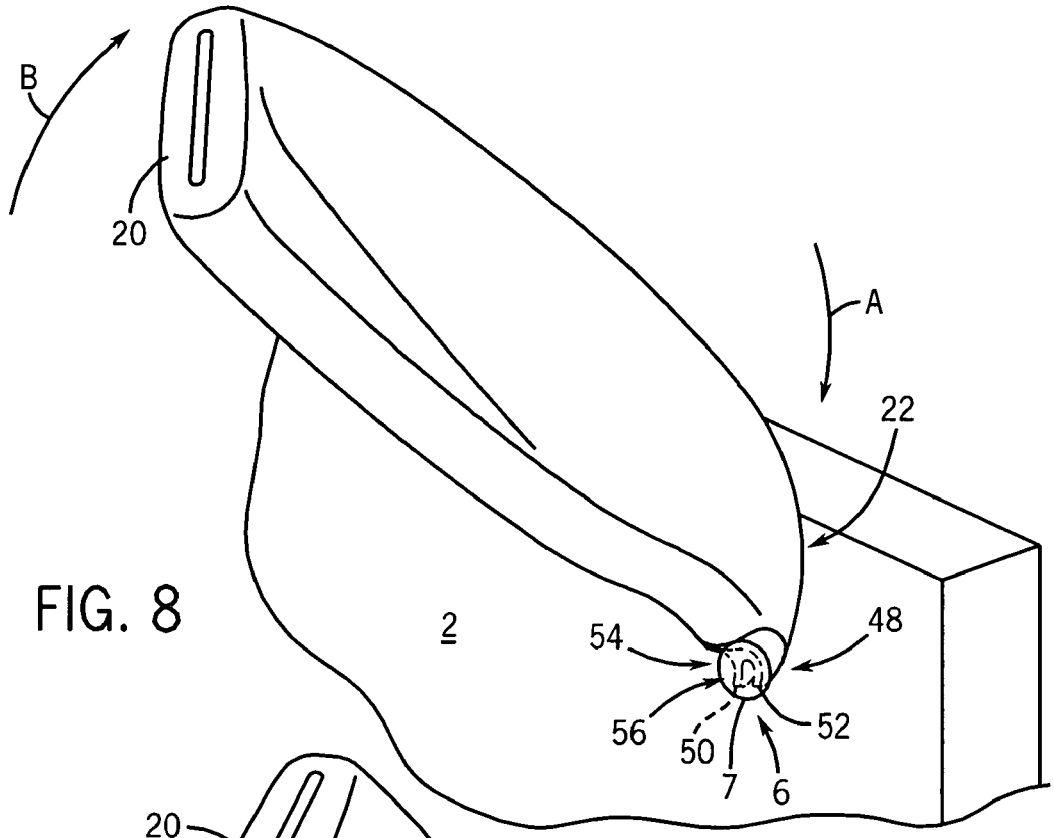
FIG. 8 shows a perspective view of the first end portion and the second side with the claw of the combination tool of FIG. 1 engaging a head of a fastener.
Figure 9:
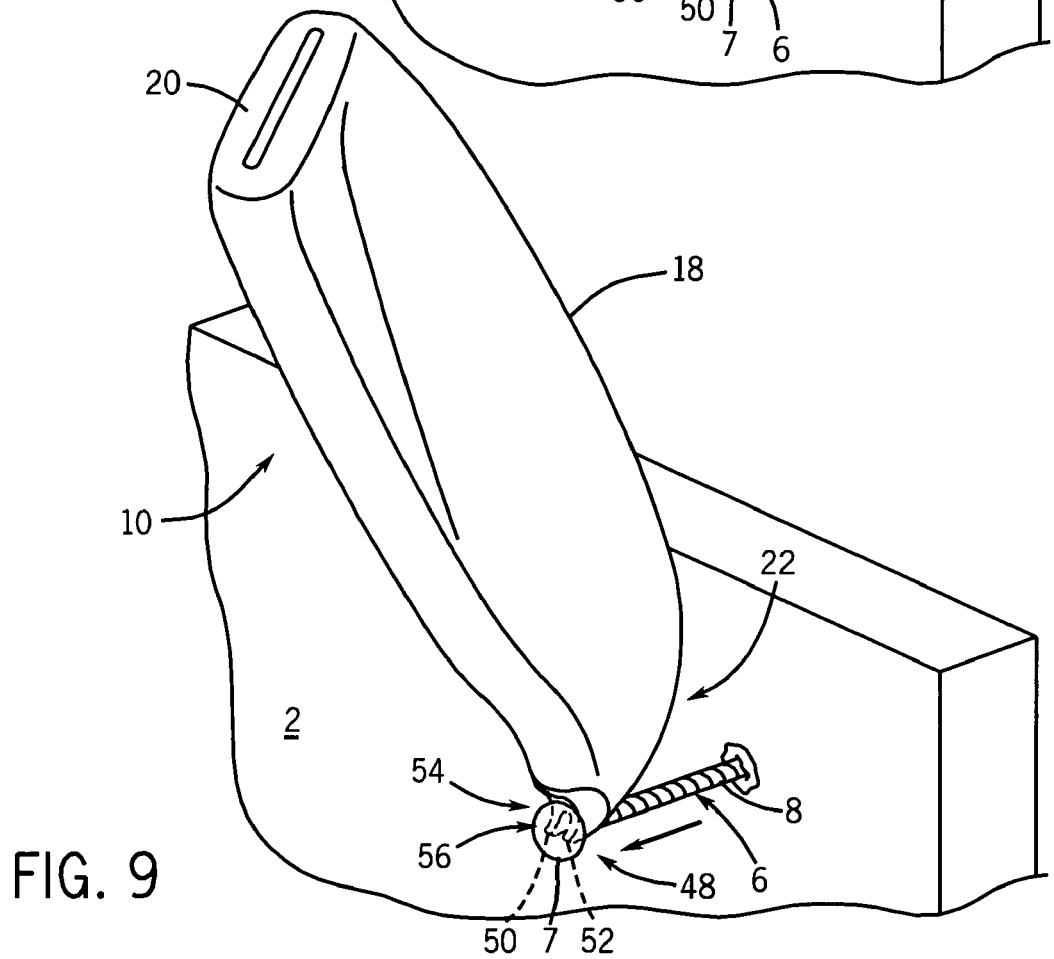
FIG. 9 shows a perspective view of the first end portion and the second side with the claw of the combination tool of FIG. 1 extracting the fastener from the piece of wallboard.

Referring now to FIGS. 6 and 8, claw 48 of combination tool 10 can be readily applied to extract a fastener 6 in a relatively soft and/or thin material such as wallboard 2. Fastener 6, has a head 7 and a shaft 8 and in this one example, is a trumpet type screw commonly employed in fastening wallboard 2 to a support structure. It is understood that fastener 6 can be any type of connector such as for example a nail, staple or any another form of threaded fastener.

Extracting one of fasteners 6 from wallboard 2 includes grasping combination tool 10 such that second end portion 22 with claw 48 is directed distally and first end portion 20 is directed proximally. As required, plug 58 is removed from claw 48. The surface of head 7 of fastener 6 is often at or sunk below the surface of wallboard 2. As required, the pointed tips of tongs 50 and 52 are employed to cut and/or dig into wallboard 2 and position tongs 50 and 52 behind head 7 and on the opposing sides of shaft 8. The narrow and pointed tongs 50 and 52 minimize the damage to wallboard 2. Notch 54 is configured to receive and engage head 7 and notch 56 is configured to receive shaft 8. Combination tool 10 is then rotated approximately about second end portion 22 and along the arcuate shape of fourth side 18 in proximity to second end portion 22 against wallboard 2. This motion repositions claw 48 away from wallboard 2 and extracts fastener 6 from wallboard 2. The portion of fourth side 18 that is in proximity to second end portion 22 functions as a fulcrum for the extraction of fastener 6 from wallboard 2. In addition, the portion of fourth side 18 in proximity to second end portion 22 preferably has a width and an arcuate shape that spreads the load of the extraction and that can minimize the damage to wallboard 2 during the extraction process.

In an alternative embodiment of claw 40 with tongs 50 and 52 in tandem along the longitudinal axis, tongs 50 and 52 are positioned behind head 7 as described above, but combination tool 10 is rotated about the longitudinal axis to extract fastener 6. Once fastener 6 has been extracted and removed from claw 48, plug 58 can be repositioned to preclude the undesired catching of tongs 50 and 52.

In the preceding specification, the present disclosure has been described with reference to specific exemplary embodiments thereof. It will be evident, however, that various modifications, combinations and changes may be made thereto without departing from the broader spirit and scope of the invention as set forth in the claims that follow. For example, while the combination tool 10 is described herein as adapted for use with cutting blade 46, it is understood that combination tool 10 can be selectively used without blade 46. Similarly, while the housing of combination tool 10 is described herein as having four sides and an approximately tapered rectangular cross-section, it is understood that the housing can have any shape to include cylindrical, spherical or, for example, have any number of sides. Further, while channel 30 is described as being aligned with the longitudinal axis, it is understood that channel 30 can have any alignment relative to the longitudinal axis and still perform its function. In addition, though the present invention is described in terms of a series of embodiments, each embodiment of the present invention can combine one or more novel features of the other embodiments. The specification and drawings are accordingly to be regarded in an illustrative manner rather than a restrictive sense.

What is claimed is:

1. A combination tool that comprises:

a housing that comprises a first side and an opposed second side, a third side and an opposed fourth side, the housing includes a first end portion and an opposed second end portion, the first end portion and second end portion define a longitudinal axis, the first side, second side, third side and fourth side connected to define the housing, the housing defines a cavity therein in fluid communication with an aperture in the first end portion;

a razor mechanism connected to the housing, the razor mechanism adapted to receive a cutting blade, the razor mechanism for the movement of the cutting blade between a first position in the cavity and a second position wherein the cutting blade extends through the aperture;

a channel defined in the first side that includes a floor, a first sidewall and a second sidewall, the first side wall and the second sidewall have first edges that are connected to the floor and second edges that connect to a first side of the housing, the first sidewall and the second side wall are aligned, the first sidewall includes a first slot and the second sidewall includes an opposed second slot, the first slot and the second slot positioned in fixed spaced relation from the floor and the second edge, the slots adapted to receive a rasp, the slots adapted to recess a cutting surface of the rasp in the channel such that at least a portion of the sidewalls extend between the cutting surface and the second edges; and a claw defined by the housing, the claw includes a first tong and a second tong, the claw adapted for the extraction of fasteners from soft materials.

2. The combination tool of claim 1 wherein the sidewalls define a plurality of slots adapted to vary the position of the rasp relative to the floor.

3. The combination tool of claim 1, wherein the second end portion defines the claw.

4. The combination tool of claim 1, wherein the claw defines a first notch that is adapted to receive the head of a fastener.

5. The combination tool of claim 4, wherein the first tong and the second tong have terminal ends that taper to define a point.

6. The combination tool of claim 1, wherein the floor of the channel includes a cutting surface.

7. The combination tool of claim 1, wherein the floor of the channel is removable and replaceable.

8. The combination tool of claim 1, wherein the claw includes a selectively removable and replaceable plug.

9. The combination tool of claim 1 that further includes a set of removable and replaceable cutting surfaces.

10. The combination tool of claim 1, wherein the housing includes an attachment mechanism that secures the rasp in the slots in the sidewalls.

11. The combination tool of claim 1, wherein the first side and the second side have a first width and the third side and fourth side have a second width that is less than the first width and the channel defined in at least one of the sides with the first width.

12. A hand held combination tool adapted for use with the installation of panels, the combination tool comprises:

a housing that includes a first side and an opposed second side, a third side and an opposed fourth side, the housing has a first end portion and an opposed second end portion, the first end portion and second end portion define a longitudinal axis, the first side, second side, third side and fourth side connected to define the housing;

a razor mechanism connected to the housing, the housing defines an interior cavity in fluid communication with an aperture in the first end portion, the razor mechanism moves the cutting blade between a first position in the cavity and a second position extending through the aperture;

a channel defined in the first side of the housing, the channel includes a floor, a first sidewall and a second sidewall, the first side wall and second sidewall have a first edge that is connected to the floor and a second edge that is connected to the first side of the housing, the first sidewall and the second side wall are opposed walls, the floor of the channel defines a cutting surface; and a claw connected to the second end portion, the claw includes at least two tongs separated by a notch, the claw adapted for extracting fasteners from soft materials.

13. The combination tool of claim 12, wherein the channel sidewalls define slots adapted to position a rasp in fixed spaced relation relative to the floor.

14. The combination tool of claim 13, wherein the floor is removable and replaceable.

15. The combination tool of claim 12, wherein the housing includes a removable and replaceable plug for the claw.

* * * * *